US010821733B2

(12) United States Patent
Kagaya

(10) Patent No.: US 10,821,733 B2
(45) Date of Patent: Nov. 3, 2020

(54) LIQUID COLLECTION DEVICE WITH SUCTIONER FOR SUCKING LIQUID

(71) Applicant: RISO KAGAKU CORPORATION, Tokyo (JP)

(72) Inventor: Daichi Kagaya, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/456,495

(22) Filed: Jun. 28, 2019

(65) Prior Publication Data

US 2020/0016897 A1 Jan. 16, 2020

(30) Foreign Application Priority Data

Jul. 10, 2018 (JP) ..... 2018-130514

(51) Int. Cl.
*B41J 2/165* (2006.01)
*B41J 2/17* (2006.01)

(52) U.S. Cl.
CPC ..... *B41J 2/16523* (2013.01); *B41J 2/1721* (2013.01)

(58) Field of Classification Search
CPC .. B41J 2/16523; B41J 2/1721; B41J 2/16585; B41J 2/18
USPC ..... 347/22, 29, 30, 33
See application file for complete search history.

(56) References Cited

U.S. PATENT DOCUMENTS 8,100,500 B2 * 1/2012 Bansyo ..... B41J 2/16532 347/19
8,622,084 B2 1/2014 Ishii et al.

FOREIGN PATENT DOCUMENTS

JP 2010-181504 A 8/2010

* cited by examiner

*Primary Examiner* — An H Do
(74) *Attorney, Agent, or Firm* — Greenblum & Bernstein, P.L.C.

(57) ABSTRACT

A liquid collection device includes: a suction tank configured to suck and collect liquid accumulated in a liquid reservoir; a suction passage connecting the liquid reservoir and an inlet opened in a lower portion of the suction tank to each other; a suctioner configured to generate a negative pressure in the suction tank and suck the liquid from the liquid reservoir into the suction tank via the suction passage by using the generated negative pressure; and a controller configured to control the suctioner to terminate suction of the liquid into the suction tank upon continuance of a state where a pressure in the suction tank is equal to or greater than a threshold for a prescribed time or more after start of the suction.

8 Claims, 6 Drawing Sheets

LIQUID COLLECTION DEVICE WITH SUCTIONER FOR SUCKING LIQUID

CROSS REFERENCE TO RELATED APPLICATION

This application is based upon and claims the benefit of priority from the prior Japanese Patent Application No. 2018-130514, filed on Jul. 10, 2018, the entire contents of which are incorporated herein by reference.

BACKGROUND

1. Technical Field

The disclosure relates to a liquid collection device which collects liquid.

2. Related Art

In an inkjet printer, a maintenance operation of an inkjet head is performed for purposes such as removing dust attaching to the inkjet head and stabilizing the physical properties of ink in nozzles.

As an example of the maintenance operation of the inkjet head, there is known a series of operations as follows: a so-called purging in which the ink is forcedly discharged from the nozzles is performed and then a nozzle surface of the inkjet head is wiped with a wiper.

The ink discharged in the maintenance operation of the inkjet head as described above is received by an ink receptor. The ink accumulated in the ink receptor is collected as waste liquid.

As a technique of collecting liquid such as ink, there is known a technique in which negative pressure is generated in a suction tank and the liquid is sucked and collected into the suction tank by using the generated negative pressure. In this technique, when mist is generated in the suction tank, the mist adheres to parts such an air pump configured to generate the negative pressure in the suction tank and reduces the life of the parts in some cases.

Regarding this mist, Japanese Patent Application Publication No. 2010-181504 discloses a technique of suppressing generation of mist in the suction tank. In a liquid suction tank (suction tank) disclosed in Japanese Patent Application Publication No. 2010-181504, liquid flows into it from a liquid inlet provided in an upper portion of the liquid suction tank. The liquid suction tank is provided with a baffle plate which the liquid flowing into the tank hits and a channel member which guides the liquid having hit the baffle plate to a liquid surface. This suppresses generation of mist caused by the liquid falling and splashing on the liquid surface.

SUMMARY

In the technique of Japanese Patent Application Publication No. 2010-181504, since the baffle plate and the channel member are provided, the structure in the suction tank is complex.

The present disclosure relates to a liquid collection device which can reduce mist generated in a suction tank while avoiding a complex structure in the suction tank.

A liquid collection device in accordance with some embodiments includes: a suction tank configured to suck and collect liquid accumulated in a liquid reservoir; a suction passage connecting the liquid reservoir and an inlet opened in a lower portion of the suction tank to each other; a suctioner configured to generate a negative pressure in the suction tank and suck the liquid from the liquid reservoir into the suction tank via the suction passage by using the generated negative pressure; and a controller configured to control the suctioner to terminate suction of the liquid into the suction tank upon continuance of a state where a pressure in the suction tank is equal to or greater than a threshold for a prescribed time or more after start of the suction.

According to the aforementioned configuration, it is possible to reduce mist generated in the suction tank while avoiding a complex structure in the suction tank.

DETAILED DESCRIPTION

Figure 1:
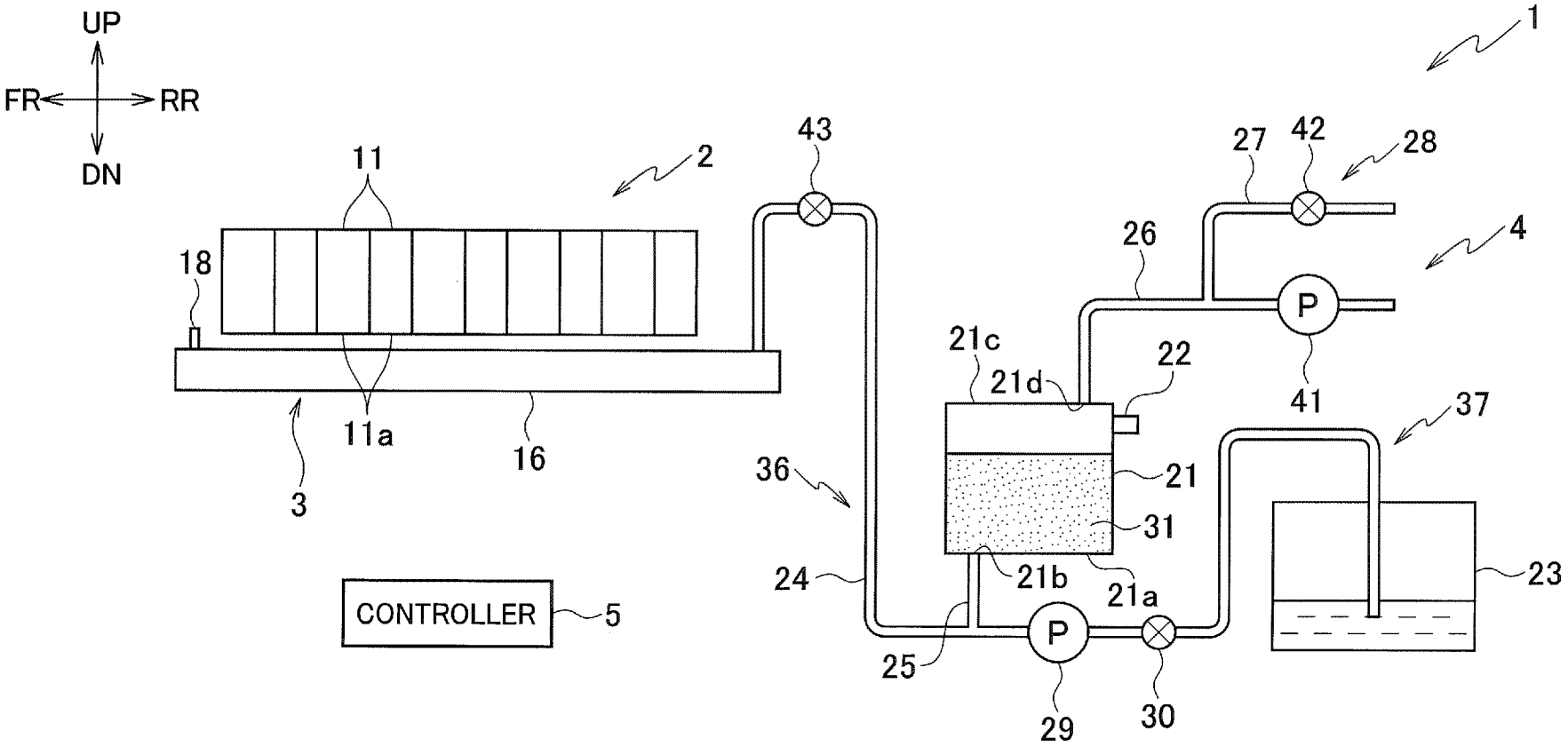
FIG. 1 is a schematic configuration diagram of an inkjet printer according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
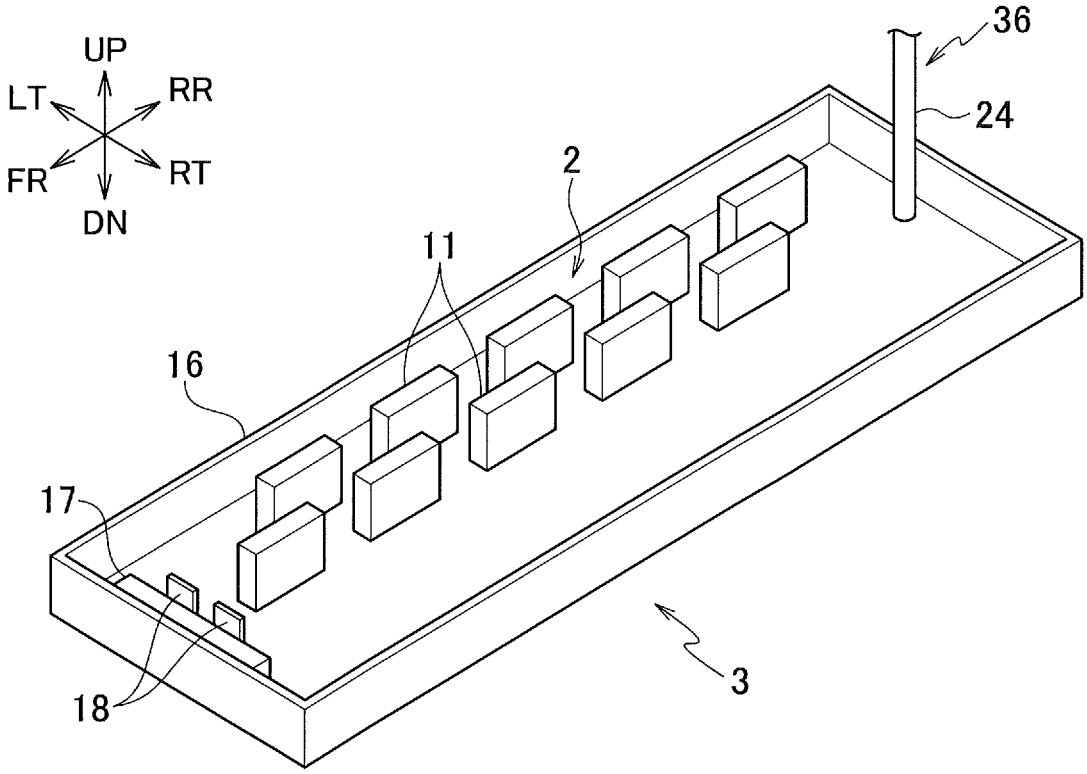
FIG. 2 is a perspective view illustrating schematic configurations of an inkjet head and a maintainer in the inkjet printer illustrated in FIG. 1.
Figure 3:
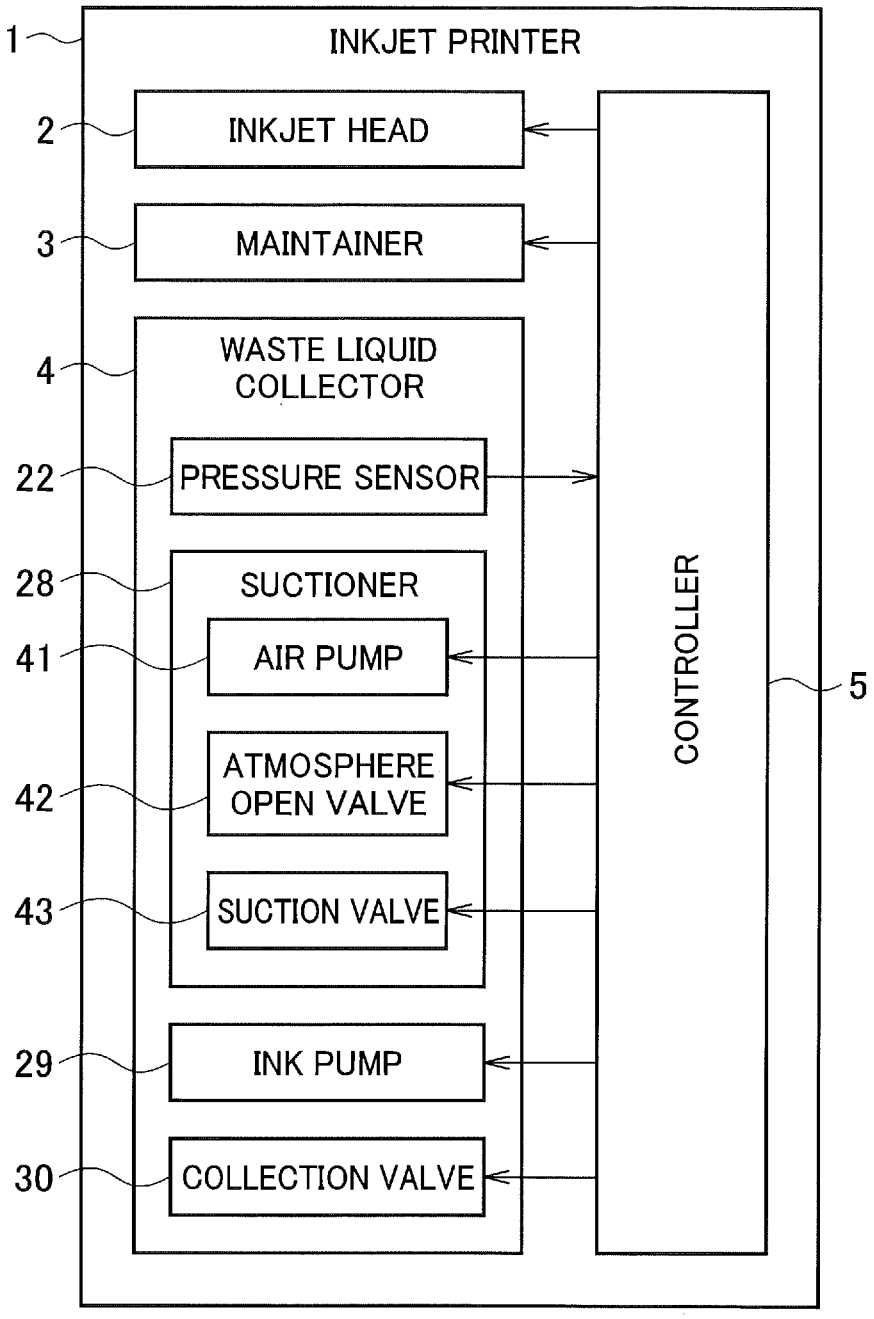
FIG. 3 is a control block diagram of the inkjet printer illustrated in FIG. 1.

FIG. 1 is a schematic configuration diagram of an inkjet printer provided with a liquid collection device according to an embodiment. FIG. 2 is a perspective view illustrating schematic configurations of an inkjet head 2 and a maintainer 3 in the inkjet printer 1 illustrated in FIG. 1. FIG. 3 is a control block diagram of the inkjet printer 1 illustrated in FIG. 1. In the following description, up, down, front, and rear indicated by the arrows in FIG. 1 are referred to as directions of up, down, front, and rear. An up-down direction is the vertical direction. Moreover, a direction orthogonal to the sheet surface of FIG. 1 is referred to as left-right direction. In FIGS. 1 and 2, directions of right, left, up, down, front, and rear are denoted by RT, LT, UP, DN, FR, and RR, respectively.

As illustrated in FIGS. 1 and 3, the inkjet printer 1 according to the embodiment includes the inkjet head 2, the maintainer 3, a waste liquid collector 4, and a controller 5. Note that the waste liquid collector 4 and the controller 5 form the liquid collection device.

The inkjet head 2 prints images by ejecting ink to a print medium conveyed in the left-right direction (sub-scanning direction). The inkjet head 2 is formed to be capable of being lifted and lowered by a not-illustrated motor.

As illustrated in FIG. 2, the inkjet head 2 includes ten head modules 11. In the inkjet head 2, the ten head modules 11 are arranged in zigzag. Specifically, in the inkjet head 2, the ten head modules 11 are arranged in rows in the front-rear direction (main scanning direction) with the positions thereof in the left-right direction (sub-scanning direction) shifted from one another.

The head modules 11 each have multiple nozzles (not illustrated) aligned in the main scanning direction and eject the ink from the nozzles. The nozzles are opened on nozzle surfaces 11*a* which are lower surfaces of the head modules 11.

The maintainer 3 performs maintenance of the inkjet head 2. The maintainer 3 includes an ink receptor (liquid reservoir) 16, a wiper attachment base 17, and two wipers 18.

The ink receptor 16 receives the ink which is discharged in maintenance from the inkjet head 2 to be waste liquid. The ink receptor 16 has a tray shape opened on the upper side and is configured such that the ink being the waste liquid is accumulated in the ink receptor 16.

The ink receptor 16 is configured to be capable of being horizontally moved between a deployed position and a retreat position by a not-illustrated motor. The deployed position of the ink receptor 16 is the position of the ink receptor 16 in FIGS. 1 and 2 and is a position directly below the inkjet head 2. The retreat position of the ink receptor 16 is a position retreated rearward from the position directly below the inkjet head 2.

The wiper attachment base 17 is a member to which the wipers 18 are attached. The wiper attachment base 17 is fixed to a front end portion of the ink receptor 16.

The wipers 18 are members configured to wipe the nozzle surfaces 11*a*. The wipers 18 are made of a material such as an elastically-deformable rubber and are formed in a plate shape. The wipers 18 are fixed to the wiper attachment base 17. The two wipers 18 are arranged side by side in the left-right direction. The left wiper 18 wipes the nozzle surfaces 11*a* of the five head modules 11 on the left side out of the ten head modules 11 arranged in zigzag. The right wiper 18 wipes the nozzle surfaces 11*a* of the five head modules 11 on the right side.

The waste liquid collector 4 collects the ink (liquid) which is the waste liquid accumulated in the ink receptor 16. The waste liquid collector 4 includes a suction tank 21, a pressure sensor 22, a waste liquid tank 23, a main pipe 24, a connection pipe 25, air pump piping 26, an atmosphere open pipe 27, a suctioner 28, an ink pump 29, and a collection valve 30.

The suction tank 21 sucks and collects the ink accumulated in the ink receptor 16. The suctioner 28 generates negative pressure for sucking the ink from the ink receptor 16 in the suction tank 21. The suction tank 21 is formed in a rectangular solid shape.

An ink passing port (inlet) 21*b* is formed in the suction tank 21 to be opened in a bottom portion 21*a* thereof. Specifically, the ink passing port 21*b* is opened in a lower portion of the suction tank 21. The ink passing port 21*b* is an opening portion which allows the ink to flow into the suction tank 21 and flow out from the suction tank 21.

Moreover, an air passing port 21*d* is formed in the suction tank 21 to be opened in a ceiling portion 21*c*. The air passing port 21*d* is an opening portion which allows air to flow out from the suction tank 21 and flow into the suction tank 21.

A liquefying member 31 configured to liquefy mist generated when air flows into the suction tank 21 from the ink passing port 21*b* is arranged in the suction tank 21. The liquefying member 31 is made of a member which adsorbs and liquefies the mist and is made of, for example, porous material. The porous material may be sponge, non-woven fabric, filter, paper, or zeolite, for example.

The pressure sensor 22 detects pressure P in the suction tank 21.

The waste liquid tank 23 stores the ink sent from the suction tank 21.

The main pipe 24 forms a main portion of an ink flow path from the ink receptor 16 to the suction tank 21 and a main portion of an ink flow path from the suction tank 21 to the waste liquid tank 23. One end of the main pipe 24 is arranged above and near a bottom plate of the ink receptor 16 to face the bottom plate of the ink receptor 16 and the other end of the main pipe 24 is arranged in the waste liquid tank 23.

The connection pipe 25 connects the suction tank 21 and the main pipe 24 to each other. One end of the connection pipe 25 is connected to the bottom portion 21*a* of the suction tank 21 such that an interior space of the connection pipe 25 and an interior space of the suction tank 21 communicate with each other via the ink passing port 21*b*. The other end of the connection pipe 25 is connected to the middle of the main pipe 24.

The connection pipe 25 and a portion of the main pipe 24 on the ink receptor 16 side of a connection point with the connection pipe 25 form a suction passage 36 which connects the ink passing port 21*b* of the suction tank 21 and the ink receptor 16 to each other. The connection pipe 25 and a portion of the main pipe 24 on the waste liquid tank 23 side of the connection point with the connection pipe 25 form a collection passage 37 which connects the ink passing port 21*b* of the suction tank 21 and the waste liquid tank 23 to each other.

The air pump piping 26 forms a flow path of air sucked from the suction tank 21 by an air pump 41 to be described later. Moreover, the air pump piping 26 forms part of an air flow path which allows the suction tank 21 to be opened to the atmosphere. One end of the air pump piping 26 is connected to the ceiling portion 21*c* of the suction tank 21 such that an interior space of the air pump piping 26 and the interior space of the suction tank 21 communicate with each other via the air passing port 21*d*. The other end (atmosphere communication end) of the air pump piping 26 communicates with the atmosphere.

The atmosphere open pipe 27 forms part of the air flow path which allows the suction tank 21 to be opened to the atmosphere. One end of the atmosphere open pipe 27 is connected to the middle of the air pump piping 26 and the other end (atmosphere communication end) communicates with the atmosphere.

The suctioner 28 generates negative pressure in the suction tank 21 and performs a suction operation of sucking the ink from the ink receptor 16 into the suction tank 21 via the suction passage 36 by using the generated negative pressure. The suctioner 28 includes the air pump 41, an atmosphere open valve 42, and a suction valve 43.

The air pump 41 generates the negative pressure in the suction tank 21 by sucking air from the suction tank 21. The air pump 41 is arranged in a portion of the air pump piping 26 on the atmosphere communication end side of the connection point with the atmosphere open pipe 27.

The atmosphere open valve 42 opens and closes the air flow path in the atmosphere open pipe 27 to switch the suction tank 21 between an airtight state and an atmosphere open state.

The suction valve 43 opens and closes the ink flow path in the suction passage 36.

The ink pump 29 sends the ink from the suction tank 21 to the waste liquid tank 23. The ink pump 29 is arranged in the collection passage 37.

The collection valve 30 opens and closes the ink flow path in the collection passage 37. The collection valve 30 is arranged in a portion of the collection passage 37 on the waste liquid tank 23 side of the ink pump 29.

The controller 5 controls operations of parts of the inkjet printer 1. The controller 5 includes a CPU, a RAM, a ROM, a hard disk drive, and the like.

In the maintenance of the inkjet head 2, the controller 5 performs purging to attach the ink to the nozzle surfaces 11*a* of the head modules 11 and then moves the maintainer 3 from the deployed position to the retreat position to cause the wipers 18 to wipe the nozzle surfaces 11*a*.

Moreover, in the collection of the ink in the ink receptor 16, the controller 5 controls the suctioner 28 such that the suctioner 28 generates the negative pressure in the suction tank 21 and sucks the ink in the ink receptor 16 into the suction tank 21. In this case, the controller 5 controls the suctioner 28 such that the suctioner 28 terminates the suction of the ink into the suction tank 21 when a state where the pressure P in the suction tank 21 is a suction termination threshold (threshold) Ps or higher continues for a prescribed time T or more after the start of the suction of the ink into the suction tank 21. Details of the operation of collecting the ink in the ink receptor 16 are described later.

Next, the maintenance operation of the inkjet head 2 in the inkjet printer 1 is described.

In the maintenance of the inkjet head 2, the inkjet head 2 is arranged at a standby position (maintenance position) above a print position which is the position of the inkjet head 2 in printing. The maintainer 3 is arranged at the deployed position. When the maintainer 3 is at the deployed position, the wipers 18 are in front of the frontmost head module 11. Upper ends of the wipers 18 are located above the nozzle surfaces 11*a* of the head modules 11.

In the state where the inkjet head 2 and the maintainer 3 are arranged as described above, the controller 5 performs purging to discharge the ink from the head modules 11 of the inkjet head 2 and attach the ink to the nozzle surfaces 11*a*. In this case, part of the discharged ink sometimes drops from the nozzle surfaces 11*a* depending on the amount of ink discharged from the head modules 11 in the purging. The ink receptor 16 receives the ink dropping from the nozzle surfaces 11*a*.

After performing the purging to attach the ink to the nozzle surfaces 11*a*, the controller 5 starts moving the maintainer 3 from the deployed position to the retreat position. In the moving of the maintainer 3 from the deployed position to the retreat position, the wipers 18 come into contact with the head modules 11. When the wipers 18 come into contact with the head modules 11, the wipers 18 are pressed by the head modules 11 and elastically deform. Then, upper end portions of the wipers 18 slide on (wipe) the nozzle surfaces 11*a* with the moving of the maintainer 3.

The wipers 18 thus remove the ink attached to the nozzle surfaces 11*a* and, together with the ink, remove dust and the like on the nozzle surfaces 11*a*, thereby cleaning the nozzle surfaces 11*a*. The ink removed from the nozzle surfaces 11*a* by the wipers 18 flows to the ink receptor 16. When the maintainer 3 reaches the retreat position, the maintenance operation is terminated.

Next, an ink collection operation in the inkjet printer 1 is described.

The ink collection operation is an operation of removing the ink accumulated in the ink receptor 16 in the aforementioned maintenance operation from the ink receptor 16 by causing the waste liquid collector 4 to collect the ink from the ink receptor 16. The ink collection operation is performed, for example, when the inkjet printer 1 is turned on or every time when the maintenance operation is performed a predetermined number of times.

The ink collection operation can be performed in a state where the maintainer 3 is arranged at the deployed position and in a state where the maintainer 3 is arranged at the retreat position. Before the start of the ink collection operation, the atmosphere open valve 42 is set to the open state and the suction tank 21 is opened to the atmosphere. Moreover, the suction valve 43 and the collection valve 30 are set to the closed state.

Figure 4:
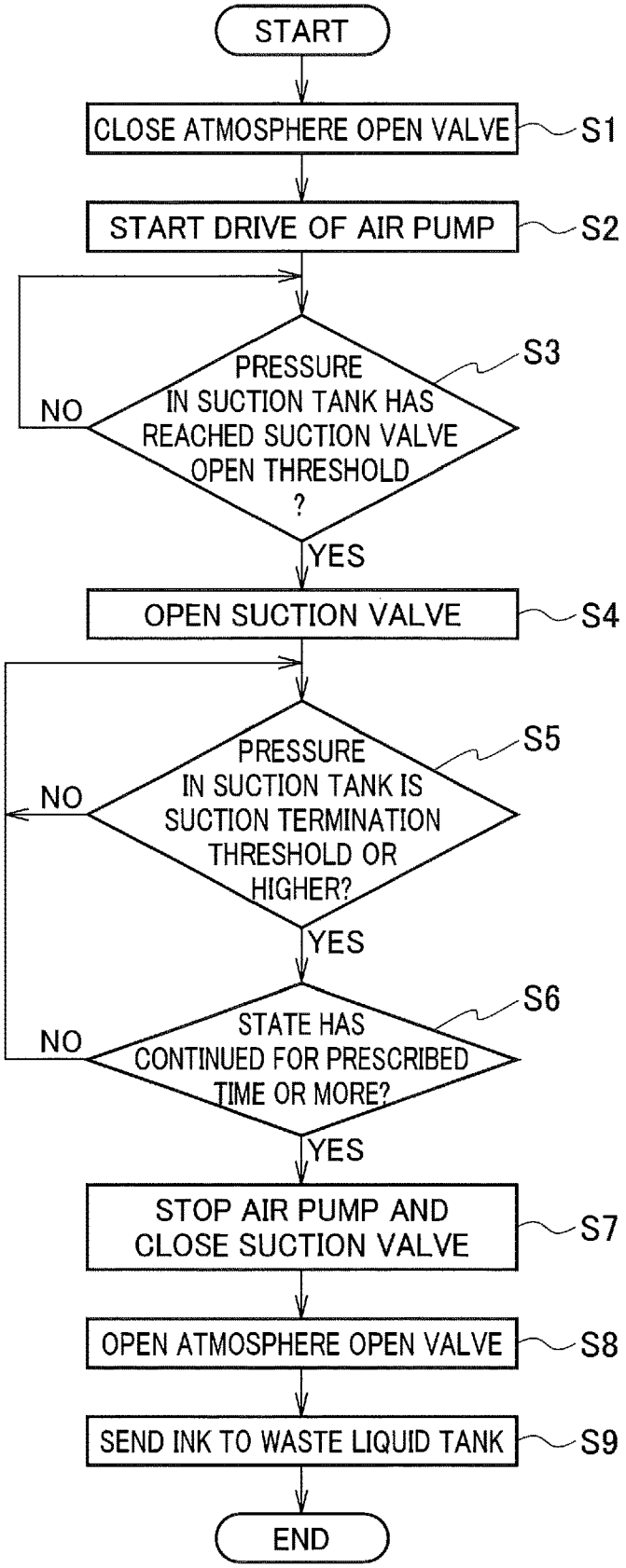
FIG. 4 is a flowchart for explaining an ink collection operation.

FIG. 4 is a flowchart for explaining the ink collection operation.

In step S1 of FIG. 4, the controller 5 closes the atmosphere open valve 42. The suction tank 21 is thereby set to the airtight state.

Then, in step S2, the controller 5 starts drive of the air pump 41. The air in the suction tank 21 thereby starts to flow out from the air passing port 21*d* and the generation of the negative pressure starts in the suction tank 21.

Next, in step S3, the controller 5 determines whether the pressure P in the suction tank 21 has reached a suction valve open threshold Pk, based on a detection value of the pressure sensor 22. When the controller 5 determines that the pressure in the suction tank 21 has not reached the suction valve open threshold Pk yet (step S3: NO), the controller 5 repeats step S3. The suction valve open threshold Pk is a value set in advance as a value of the pressure (negative pressure value) in the suction tank 21 at which the suction valve 43 is to be opened to start the suction of the ink from the ink receptor 16.

When the controller 5 determines that the pressure in the suction tank 21 has reached the suction valve open threshold Pk (step S3: YES), in step S4, the controller 5 opens the suction valve 43. The suction operation for sucking the ink into the suction tank 21 is thereby started. Specifically, the ink in the ink receptor 16 starts to be sucked into the suction tank 21 via the suction passage 36. The ink sucked from the ink receptor 16 flows into the suction tank 21 from the ink passing port 21*b*.

Before the start of the ink collection operation, the inside of the suction passage 36 is not filled by the ink and is filled almost totally by air. When the suction valve 43 is opened, the air in the suction passage 36 is sucked into the suction tank 21 and then the ink starts to be sucked into the suction tank 21.

When the amount of ink in the ink receptor 16 is small or there is no ink in the ink receptor 16 at the start of the ink collection operation, the situation where only the ink is sucked sometimes does not occur after the air in the suction passage 36 is sucked into the suction tank 21. In such a case, the ink is sucked while being mixed with air or only air continues to be sucked without the situation where only the ink is sucked into the suction tank 21 occurring.

After the suction valve 43 is opened, in step S5, the controller 5 determines whether the pressure P in the suction tank 21 is the suction termination threshold Ps or higher, based on the detection value of the pressure sensor 22. When the controller 5 determines that the pressure P in the suction tank 21 is less than the suction termination threshold Ps (step S5: NO), the controller 5 repeats step S5.

The suction termination threshold Ps is a value set in advance as a value of the pressure (negative pressure value) in the suction tank 21 used to determine the timing of terminating the suction operation. Specifically, the suction termination threshold Ps is a threshold of the pressure P in the suction tank 21 used to determine whether the suction has transitioned from the situation where only the ink is sucked into the suction tank 21 to the situation where air is sucked together with the ink as described later. The suction termination threshold Ps is a value higher (lower negative pressure) than the suction valve open threshold Pk.

When the controller 5 determines that the pressure P in the suction tank 21 is the suction termination threshold Ps or higher (step S5: YES), in step S6, the controller 5 determines whether a state where the pressure P in the suction tank 21 is the suction termination threshold Ps or higher has continued for the prescribed time T or more. When the controller 5 determines that the state where the pressure P in the suction tank 21 is the suction termination threshold Ps or higher has not continued for the prescribed time T or more (step S6: NO), the controller 5 returns to step S5.

The prescribed time T is a threshold set to determine the timing of terminating the suction operation and is a threshold of a duration of the state where the pressure P in the suction tank 21 is the suction termination threshold Ps or higher. Details of the prescribed time T are described later.

When the controller 5 determines that the state where the pressure P in the suction tank 21 is the suction termination threshold Ps or higher has continued for the prescribed time T or more (step S6: YES), in step S7, the controller 5 stops the air pump 41 and closes the suction valve 43. The suction operation is thereby terminated. Note that the controller 5 may close the suction valve 43 and then stop the air pump 41 or stop the air pump 41 and then close the suction valve 43.

Next, in step S8, the controller 5 opens the atmosphere open valve 42. The suction tank 21 is thereby set to the atmosphere open state.

Then, in step S9, the controller 5 controls the ink pump 29 and the collection valve 30 such that the ink is sent from the suction tank 21 to the waste liquid tank 23.

Specifically, the controller 5 closes the collection valve 30 and drives the ink pump 29 to send the ink from the suction tank 21 to the waste liquid tank 23. When the sending of the ink to the waste liquid tank 23 is completed, the controller 5 closes the collection valve 30.

Note that the drive of the ink pump 29 in this case only has to be such that, for example, the ink pump 29 is driven for prescribed time set in advance. Alternatively, the configuration may be such that a sensor for detecting the presence or absence of the ink is provided in the suction tank 21 and, when the sensor detects the absence of the ink in the suction tank 21, the ink pump 29 is stopped.

When the sending of the ink from the suction tank 21 to the waste liquid tank 23 is completed, the series of operations is completed.

Figure 5:
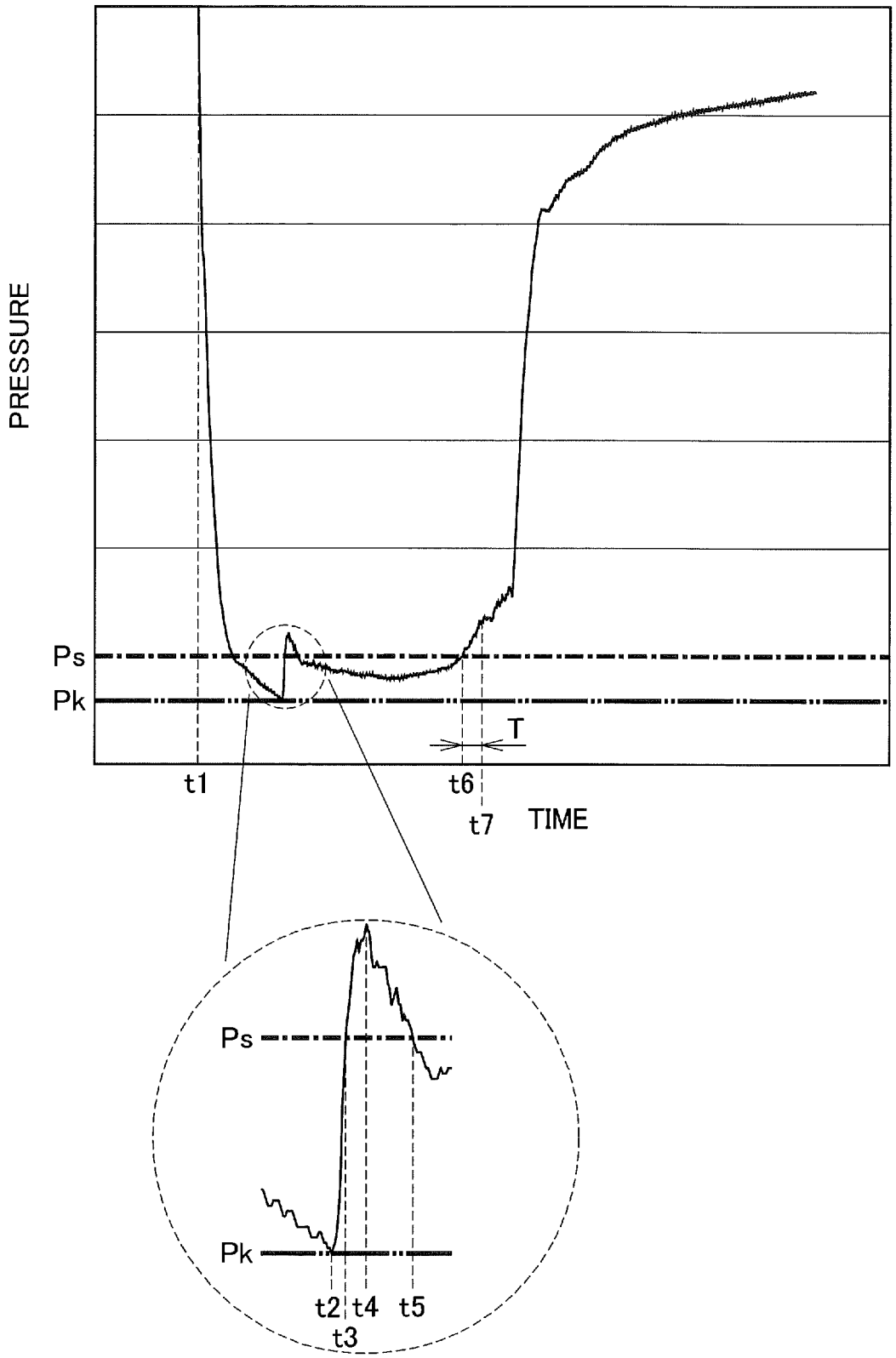
FIG. 5 is a graph illustrating an example of a change in pressure in a suction tank in the ink collection operation.

Next, with reference to FIG. 5, description is given of a relationship between the pressure P in the suction tank 21 and a sucked object in the case where the situation where the sucked object includes only the ink occurs during the suction operation in the aforementioned ink collection operation.

The situation where the sucked object includes only the ink occurs when a sufficient amount of ink is accumulated in the ink receptor 16 at the start of the ink collection operation and the end of the suction passage 36 on the ink receptor 16 side is immersed in the in the ink in the ink receptor 16.

The time point t1 in FIG. 5 is a time point at which the drive of the air pump 41 is started (step S2 in FIG. 4) in the ink collection operation.

After the drive of the air pump 41 is started, the pressure P in the suction tank 21 falls to the suction valve open threshold Pk at the time point t2. At the time point t2, the suction valve 43 is opened (step S4 in FIG. 4).

When the suction valve 43 is opened, as described above, first, the air in the suction passage 36 is sucked into the suction tank 21. The flowing of the air in the suction passage 36 into the suction tank 21 causes the pressure P in the suction tank 21 to rise from the time point t2.

When the flowing of the air in the suction passage 36 into the suction tank 21 is completed, the ink starts to flow into the suction tank 21. The ink starts to flow into the suction tank 21 at the time point t4 and the pressure P in the suction tank 21 starts to fall from the time point t4. A situation from the time point t4 is the situation where the sucked object includes only the ink. After the fall of the pressure P, the pressure P in the suction tank 21 remains at a stable level while only the ink is sucked.

When the amount of ink left in the ink receptor 16 becomes small, there occurs the situation where air is sucked into the suction tank 21 together with the ink, that is the situation where the sucked object includes the ink and air. In this situation, the air flows into the suction tank 21 and the pressure P in the suction tank 21 thereby rises.

At the time of transition from the situation where only the ink is sucked into the suction tank 21 to the situation where air is sucked into the suction tank 21 together with the ink, the sucked ink is accumulated in the suction tank 21. When air is sucked into the suction tank 21 in the situation where there is the ink in the suction tank 21, air bubbles are formed in the ink. If these air bubbles break, mist is generated. The mist may attach to parts such as the air pump 41 and reduce the life of the parts.

Accordingly, in the inkjet printer 1, when the situation where air is sucked together with the ink occurs, the suction operation is terminated to suppress generation of the mist. For this purpose, the controller 5 controls the suctioner 28 to terminate the suction operation when the state where the pressure P in the suction tank 21 is the suction termination threshold Ps or higher continues for the prescribed time T or more.

The suction termination threshold Ps is set in advance based on experiments and the like as a value which allows the controller 5 to determine that the suction has transitioned from the situation where only the ink is sucked into the suction tank 21 to the situation where air is sucked together with the ink.

The prescribed time T is set to prevent the controller 5 from erroneously determining that the situation where air is sucked together with ink has occurred when the pressure P in the suction tank 21 temporarily rises and reaches or exceeds the suction termination threshold Ps immediately after the aforementioned opening of the suction valve 43.

Assume the case where the pressure P in the suction tank 21 rises immediately after the opening of the suction valve 43 as described above. In this case, when the ink starts to flow into the suction tank 21, the pressure P in the suction tank 21 falls to a level below the suction termination threshold Ps. Specifically, in the case where the pressure P in the suction tank 21 rises immediately after the opening of the suction valve 43 and thereby reaches or exceeds the suction termination threshold Ps, the pressure P is equal to or higher than the suction termination threshold Ps in a period from the time point t3 to the time point t5 in FIG. 5. The time point t3 is a time point at which the pressure P in the suction tank 21 reaches the suction termination threshold Ps during the rise of the pressure P immediately after the opening of the suction valve 43. The time point t5 is a time point at which the pressure P falls to the suction termination threshold Ps during the fall of the pressure P from the start of the flowing of the ink into the suction tank 21.

Meanwhile, when the situation where air is sucked together with the ink occurs, the pressure P in the suction tank 21 continues to rise after reaching the suction termination threshold Ps.

Accordingly, it is possible to distinguish the situation where air in the suction passage 36 is sucked and the pressure P in the suction tank 21 thereby temporarily rises to reach or exceed the suction termination threshold Ps immediately after the opening of the suction valve 43 from the situation where the amount of ink in the ink receptor 16 decreases and the air is sucked together with the ink to cause the pressure P to reach or exceed the suction termination threshold Ps, by using the duration of the state where the pressure P in the suction tank 21 is the suction termination threshold Ps or higher.

Accordingly, in the inkjet printer 1, the prescribed time T which is the threshold of the duration of the state where the pressure P in the suction tank 21 is the suction termination threshold Ps or higher is used to determine whether the suction operation is to be terminated or not. The prescribed time T is set in advance based on experiments and the like as minimal time within such a range that the prescribed time T is longer than the time corresponding to a period between the time point t3 and the time point t5 in FIG. 5.

When the situation where air is sucked into the suction tank 21 together with the ink occurs, the pressure P reaches the suction termination threshold Ps at the time point t6 in FIG. 5. Then, at the time point t7, that is upon elapse of the prescribed time T from the time point t6, the suction operation is terminated (step S7 in FIG. 4).

Then, the atmosphere open valve 42 is opened (step S8 in FIG. 4) and the pressure P in the suction tank 21 rises and eventually reaches the atmospheric pressure.

In the period of the prescribed time T from the point of occurrence of the situation where air is sucked into the suction tank 21 together with the ink to the termination of the suction operation (time point t6 to time point t7 in FIG. 5), air bubbles are formed by the air sucked into the suction tank 21 and mist is generated by breaking of these air bubbles.

Moreover, when there is the ink in the suction tank 21 at the start of the ink collection operation, air bubbles are formed by the air in the suction passage 36 sucked into the suction tank 21 immediately after the opening of the suction valve 43 and mist is generated by breaking of these air bubbles.

To counter this, in the inkjet printer 1, the liquefying member 31 in the suction tank 21 adsorbs the mist generated by the breaking of the air bubbles and liquefies the mist. The mist is thereby reduced.

Note that, as described above, in the ink collection operation, the ink is sent from the suction tank 21 to the waste liquid tank 23 after the suction operation of the ink into the suction tank 21 is terminated. Accordingly, at the start of the ink collection operation, there is basically no ink in the suction tank 21 because the ink has been sent from the suction tank 21 to the waste liquid tank 23 in the previous ink collection operation. However, in some cases, the ink is not sent from the suction tank 21 to the waste liquid tank 23 in the previous ink collection operation for some reason and is present in the suction tank 21 at the start of the ink collection operation.

Moreover, assume a case where there is no ink in the suction tank 21 at the start of the ink collection operation. In this case, when the air in the suction passage 36 is sucked into the suction tank 21 immediately after the opening of the suction valve 43, few ink droplets adhering in the suction passage 36 turn into mist and flow into the suction tank 21. The liquefying member 31 also liquefies this mist.

When the liquid level of the ink in the suction tank 21 rises above an upper surface of the liquefying member 31, the air bubbles sometimes break above the liquefying member 31 and mist is generated. Such mist cannot be liquefied by the liquefying member 31. Accordingly, the liquefying member 31 is formed to have a height reaching the position at or above the maximum liquid level conceivable in the suction tank 21.

Figure 6:
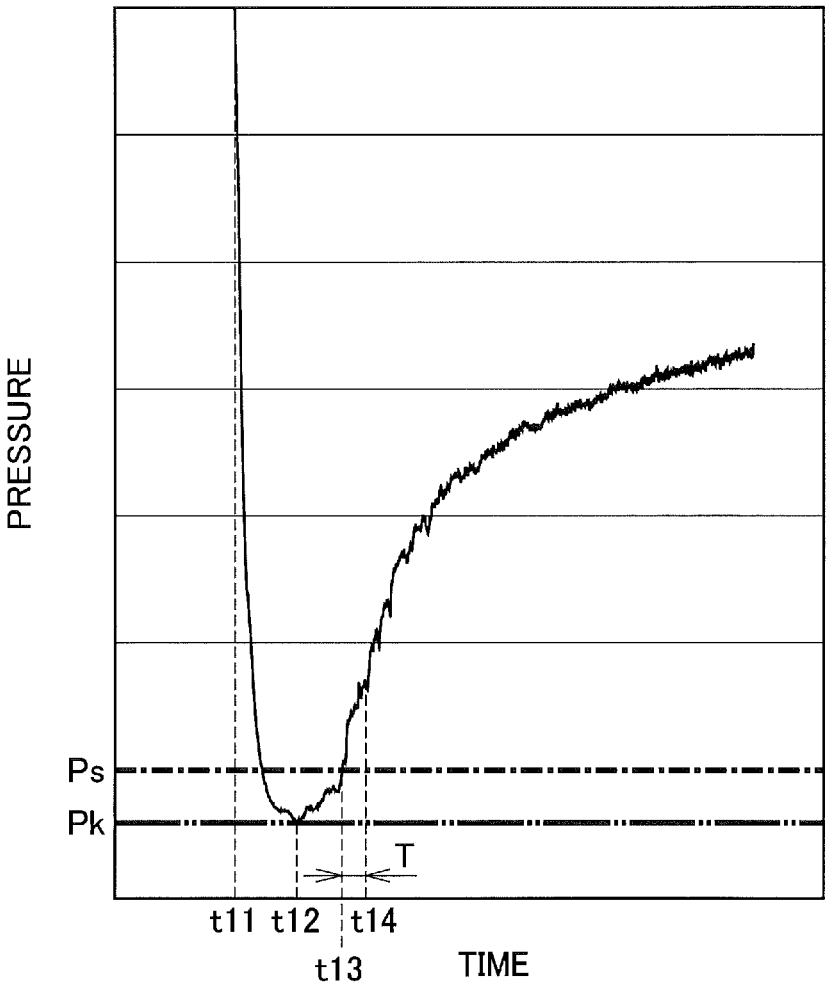
FIG. 6 is a graph illustrating another example of the change in the pressure in the suction tank in the ink collection operation.

Next, with reference to FIG. 6, description is given of how the pressure P in the suction tank 21 changes when the situation where the sucked object includes only the ink does not occur during the suction operation in the ink collection operation.

When a sufficient amount of ink is not accumulated in the ink receptor 16 at the start of the ink collection operation, the situation where the sucked object includes only the ink sometimes does not occur. In such a case, in the suction operation, the ink is sucked together with air or only air continues to be sucked without the situation where only the ink is sucked into the suction tank 21 occurring after the air in the suction passage 36 is sucked into the suction tank 21. FIG. 6 is an example in which the situation where air is sucked together with the ink occurs without the situation where only the ink is sucked occurring in the suction operation.

The time point t11 in FIG. 6 is a time point at which the drive of the air pump 41 is started (step S2 in FIG. 4) in the ink collection operation.

After the drive of the air pump 41 is started, the pressure P in the suction tank 21 falls to the suction valve open threshold Pk at the time point t12. At the time point t12, the suction valve 43 is opened (step S4 in FIG. 4).

When the suction valve 43 is opened, first, the air in the suction passage 36 is sucked into the suction tank 21. The flowing of the air in the suction passage 36 into the suction tank 21 causes the pressure P in the suction tank 21 to rise from the time point t12.

When the flowing of the air in the suction passage 36 into the suction tank 21 is completed, the situation where air is sucked together with the ink from the ink receptor 16 occurs. Since the situation where only the ink is sucked does not occur, the pressure P in the suction tank 21 does not fall greatly as in the example of FIG. 5 described above and continues to rise.

The pressure P in the suction tank 21 reaches the suction termination threshold Ps at the time point t13. At the time point t14, that is upon elapse of the prescribed time T from the time point t13, the suction operation is terminated (step S7 in FIG. 4).

Then, the atmosphere open valve 42 is opened (step S8 in FIG. 4) and the pressure P in the suction tank 21 rises and eventually reaches the atmospheric pressure as in the example of FIG. 5 described above.

Also in the example of FIG. 6, when there is the ink in the suction tank 21 at the start of the ink collection operation, air bubbles are formed by the air in the suction passage 36 sucked into the suction tank 21 immediately after the opening of the suction valve 43 and mist is generated by breaking of these air bubbles as in the example of FIG. 5 described above. Moreover, in the example of FIG. 6, when there is the ink in the suction tank 21 at the start of the ink collection operation, air bubbles are formed by the air sucked together with the ink also after the completion of the flowing of the air in the suction passage 36 into the suction tank 21 and mist is generated by breaking of these air bubbles.

To counter this, the liquefying member 31 in the suction tank 21 adsorbs and liquefies the mist to reduce the mist.

Moreover, assume a case where there is no ink in the suction tank 21 at the start of the ink collection operation. In this case, also in the example of FIG. 6, when the air in the suction passage 36 is sucked into the suction tank 21 immediately after the opening of the suction valve 43, few ink droplets adhering in the suction passage 36 turn into mist and flow into the suction tank 21 as in the example of FIG. 5 described above. The liquefying member 31 also liquefies this mist.

Moreover, in the example of FIG. 6, in the case where there is no ink in the suction tank 21 at the start of the ink collection operation, when the air is sucked together with the ink, ink droplets which are larger than the mist flow into the suction tank 21. The liquefying member 31 captures these droplets.

Note that, in the case where there is almost no ink in the ink receptor 16 at the start of the ink collection operation, in the suction operation, only air continues to be sucked also after the air in the suction passage 36 is sucked into the suction tank 21. Also in this case, as in the example of FIG. 6, the pressure P in the suction tank 21 continues to rise after the opening of the suction valve 43. Then, when the pressure P in the suction tank 21 reaches the suction termination threshold Ps, the suction operation is terminated at a time point where the prescribed time T elapses from the time point of the pressure P reaching the suction termination threshold Ps.

As described above, in the inkjet printer 1, the ink passing port 21*b* is opened in the lower portion of the suction tank 21. Accordingly, it is possible to suppress generation of mist which may otherwise occur if the ink inlet from the ink receptor 16 is provided in the upper portion of the suction tank 21 and the ink falls from the inlet and splashes on the bottom portion 21*a* or the liquid surface of the ink in the suction tank 21. Moreover, unlike the configuration in which the inlet is provided in the upper portion of the suction tank 21, the suction tank 21 does not have to be provided with a structure which guides the ink to reduce the falling distance from the inlet and thereby suppresses the generation of mist. Thus, it is possible to avoid a complex structure in the suction tank.

Moreover, in the inkjet printer 1, when the state where the pressure P in the suction tank 21 is the suction termination threshold Ps or higher continues for the prescribed time T or more after the start of the suction of the ink into the suction tank 21, the controller 5 controls the suctioner 28 such that the suction is terminated. This reduces the time in which the suction operation is performed under the situation where air is sucked into the suction tank 21. Accordingly, it is possible to suppress generation of mist caused by breaking of air bubbles formed by air sucked into the suction tank 21.

Hence, the inkjet printer 1 can reduce mist generated in the suction tank 21 while avoiding a complex structure in the suction tank 21.

Moreover, in the inkjet printer 1, the liquefying member is arranged in the suction tank 21. Accordingly, the liquefying member 31 liquefies the mist even when, for example, air is sucked into the suction tank 21 and mist is thereby generated in the period of the prescribed time T from the point where the pressure P in the suction tank 21 reaches the suction termination threshold Ps to the point of the termination of the suction. Hence, mist can be further reduced.

Although the configuration in which the ink passing port 21*b* being the ink inlet is opened in the bottom portion 21*a* of the suction tank 21 is described in the aforementioned embodiment, the position of the ink inlet is not limited to this. The ink inlet only needs to be arranged in the lower portion of the suction tank 21, below a predetermined height from the bottom portion 21*a* such that no mist is generated by the ink falling from the inlet and splashing on the bottom portion 21*a* or the liquid surface of the ink in the suction tank 21. The ink inlet may be arranged, for example, on a side surface of the suction tank 21, as long as it is in the lower portion of the suction tank 21.

Moreover, the liquefying member 31 may be omitted.

Furthermore, the waste liquid tank 23, the ink pump 29, collection valve 30, and the collection passage 37 may be omitted.

Moreover, the present disclosure can be applied to a device which collects liquid other than the ink.

The embodiments of the disclosure have, for example, the following configurations.

A liquid collection device includes: a suction tank configured to suck and collect liquid accumulated in a liquid reservoir; a suction passage connecting the liquid reservoir and an inlet opened in a lower portion of the suction tank to each other; a suctioner configured to generate a negative pressure in the suction tank and suck the liquid from the liquid reservoir into the suction tank via the suction passage by using the generated negative pressure; and a controller configured to control the suctioner to terminate suction of the liquid into the suction tank upon continuance of a state where a pressure in the suction tank is equal to or greater than a threshold for a prescribed time or more after start of the suction.

The liquid collection device may further include a liquefying member arranged in the suction tank and configured to liquefy mist of the liquid.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A liquid collection device comprising:

a suction tank configured to suck and collect waste ink discharged from an inkjet head and accumulated in a liquid reservoir;

a suction passage connecting the liquid reservoir and an inlet opened in a lower portion of the suction tank to each other;

a suctioner configured to generate a negative pressure in the suction tank and suck the waste ink from the liquid reservoir into the suction tank via the suction passage by using the generated negative pressure; and a controller configured to control the suctioner to terminate suction of the waste ink into the suction tank upon continuance of a state where a pressure in the suction tank is equal to or greater than a threshold for a prescribed time or more after start of the suction.

2. The liquid collection device according to claim 1, further comprising a liquefying member arranged in the suction tank and configured to liquefy mist of the waste ink.

3. The liquid collection device according to claim 1, wherein the pressure threshold is a predetermined pressure threshold having a value at which the suction has transitioned from the situation where only the waste ink is sucked into the suction tank from the liquid reservoir to the situation where air is sucked together with the waste ink.

4. The liquid collection device according to claim 1, wherein mist of the waste ink in the liquid reservoir is generated when air flows into the suction tank from the suction passage and the inlet in the lower portion of the suction tank, and wherein the device further comprises a liquefying member arranged in the suction tank and configured to liquefy the mist of the waste ink.

5. The liquid collection device according to claim 1, further comprising a liquefying member arranged at the bottom of the suction tank, having a height reaching a position at or above a maximum waste ink level of the suction tank, and configured to liquefy mist of the waste ink.

6. The liquid collection device according to claim 1, further comprising a liquefying member made of a porous member that adsorbs and liquefies mist of the waste ink.

7. The liquid collection device according to claim 1, further comprising a liquefying member that liquefies mist of the waste ink and includes one of: a sponge, non-woven fabric, a filter, paper, and zeolite.

8. The liquid collection device according to claim 1, wherein the threshold is a suction termination threshold, and wherein the prescribed time is set to prevent the controller from erroneously determining that air is sucked together with waste ink from the liquid reservoir when the pressure in the suction tank temporarily rises and reaches or exceeds the suction termination threshold for a predetermined time immediately after the opening of a suction valve in the suction passage connecting the liquid reservoir to the suction tank.

* * * * *